US006132244A

United States Patent [19]

Leeman et al.

[11] Patent Number: 6,132,244

[45] Date of Patent: Oct. 17, 2000

[54] RF COAXIAL ANGLE-CONNECTOR PART AND METHOD FOR ITS PRODUCTION

[75] Inventors: Reginald Leeman, Ostend; Edgard Acke; Bernard Houtteman, both of Oostkamp; Roger Schoubben, Zedelgem, all of Belgium

[73] Assignee: Siemens Aktiengesellschaft, Munich, Germany

[21] Appl. No.: 09/176,816

[22] Filed: Oct. 22, 1998

[30] Foreign Application Priority Data

Oct. 22, 1997 [DE] Germany ..... 197 46 637

[51] Int. Cl.[7] ..... H01R 12/00; H01R 13/60; H01R 9/05; H01R 4/58

[52] U.S. Cl. ..... 439/541.5; 439/63; 439/579; 439/581; 439/931

[58] Field of Search ..... 439/63, 578, 579, 439/580, 581, 351, 358, 329, 86, 541.5, 540.1, 931

[56] References Cited

U.S. PATENT DOCUMENTS

| | | | |
|---|---|---|---|
| 3,566,334 | 2/1971 | Ziegler | 339/64 |
| 4,659,166 | 4/1987 | Morningstar et al. | 439/580 |
| 5,536,179 | 7/1996 | Olsson et al. . | |
| 5,645,454 | 7/1997 | Kosmala | 439/675 |
| 5,647,749 | 7/1997 | Atoh et al. . | |
| 5,735,711 | 4/1998 | Fremgen | 439/578 |
| 5,897,384 | 4/1999 | Hosler, Sr. | 439/63 |

FOREIGN PATENT DOCUMENTS 0 555 933 B1 8/1993 European Pat. Off. .

*Primary Examiner*—Paula Bradley
*Assistant Examiner*—Edwin A. León
*Attorney, Agent, or Firm*—Herbert L. Lerner; Laurence A. Greenberg; Werner H. Stemer

[57] ABSTRACT

A RF coaxial angle-connector part embodied as a coaxial connector-part module having coaxial connector parts disposed at the front in a housing. The metallized-plastic housing has, on a bottom at an edge, a multiplicity of contact bearing feet with bearing surfaces which constitute SMD connections. The contact bearing feet are used both for mounting the housing on a base as well as for conductively connecting the SMD connections to connections that are allocated to the latter on the base. The conductive connections between coaxial inner conductors of the coaxial connector parts and the SMD connections includes insulated metallic inner-conductor connection pieces that have in each case two sections which are disposed essentially perpendicular to one another. The two sections include an inner-conductor plug part and an SMD inner-conductor foot. The inner-conductor plug parts are oriented in each case perpendicular to the coaxial connector parts, and have, at their free end, a press-fit contact head for a highly conductive connection to associated coaxial inner conductors of the coaxial connector parts.

19 Claims, 5 Drawing Sheets section V-V section VI-VI section VII-VII

RF COAXIAL ANGLE-CONNECTOR PART AND METHOD FOR ITS PRODUCTION

BACKGROUND OF THE INVENTION

Field of the Invention

The invention relates to a RF coaxial angle-connector part embodied as a coaxial connector-part module having coaxial connector parts disposed in a front wall of a housing. The RF coaxial angle-connector part is mounted on a base, for example a printed circuit board. Coaxial inner conductors are inserted, in each case in an insulated fashion, inside of coaxial outer conductors that are inserted, screwed and/or integrated in the housing. The metallized-plastic housing of the coaxial connector-part module has, on a bottom edge, a multiplicity of contact bearing feet having bearing surfaces that constitute Surface Mounted Device (hereinafter, "SMD") connections. The contact bearing feet are used both for mounting the housing on the base as well as for conductively connecting the SMD connections to connections that are disposed on the base. The metallization of the housing is divided up into metallized regions that are electrically isolated from one another for DC isolation at least between the metallization of the contact bearing feet having SMD connections and the remainder of the metallization of the housing. Conductive connections between the coaxial inner-conductor ends on the side where the SMD connections are located and the SMD connections are produced by insulated metallic inner-conductor connection pieces.

Such an RF coaxial angle-connector part has already been disclosed in German Patent 197 16 139 C1. The construction of such a coaxial connector-part module has the advantage, over such monoblocks of known configuration as are disclosed, for example, in European Patent EP 0 555 933 B1, that it can be manufactured much more cheaply in terms of production technology and with a lower overall weight.

SUMMARY OF THE INVENTION

It is accordingly an object of the invention to provide a RF coaxial angle-connector part and method for its production that overcomes the above-mentioned disadvantages of the prior art devices and methods of this general type, in which the production-related requirements for the coaxial connector-part module in its embodiment as an RF coaxial angle-connector part is simple in construction and can be fully automatically assembled.

With the foregoing and other objects in view there is provided, in accordance with the invention, in combination with a base having connectors, a RF coaxial angle-connector part, including: a coaxial connector-part module to be mounted on the base having a plastic housing with recesses formed therein, a front wall and a bottom with an edge, the housing also has metallized surface areas; coaxial connector parts disposed in the front wall of the housing, the coaxial connector parts have coaxial outer conductors and straight rod shaped inner conductors with ends disposed in an insulated fashion in the coaxial outer conductors; a multiplicity of contact bearing feet having bearing surfaces constituting SMD connections with metallized surfaces disposed at the edge of the bottom of the housing for mounting the housing on the base and conductively connecting the SMD connections to the connectors of the base; the metallized surface areas of the housing are divided up into metallized regions at least between the metallized surfaces of the SMD connections and a remainder of the metallized surface areas of the housing for electrically isolating the metallized regions from one another for DC isolation; metallic inner-conductor connection pieces disposed in an insulated fashion in the recesses of the housing perpendicular to the coaxial connector parts, the inner-conductor connection pieces each have an inner-conductor plug part and an SMD inner-conductor foot disposed substantially perpendicular to the inner-conductor plug part, the SMD inner-conductor foot extends into a respective bearing surface of the contact bearing feet, the inner-conductor plug part have a press-fit contact head receiving one of the ends of a respective coaxial inner conductor and forming a highly conductive connection with the respective coaxial inner conductor; and the inner-conductor connection pieces, the coaxial connector parts and the contact bearing feet forming coaxial connection paths dimensioned to have an at least substantially constant characteristic impedance.

The invention achieves the object in that the inner-conductor connection pieces have in each case two sections which are disposed essentially perpendicular to one another. More specifically, there is an inner-conductor plug part and an SMD inner-conductor foot, in that the inner-conductor plug parts which are oriented in each case perpendicular to the coaxial connector parts and are disposed in an insulated fashion inside housing recesses have, at their free end, a press-fit contact head for a highly conductive connection to the coaxial inner conductors. In that the SMD inner-conductor feet of the inner-conductor connection pieces extend, at the bottom, into the bearing surfaces of the contact bearing feet allocated to them, and in that appropriate dimensioning of the coaxial connection paths formed in this manner between the coaxial connector parts at the front and the SMD connections at the bottom guarantees an at least approximately constant impedance characteristic.

In RF coaxial angle-connector parts, it is a relatively complex matter to insert the rectangular coaxial inner-conductors held in the dielectric sleeves into the metallized plastic housing. If high production costs are acceptable, then the rectangular coaxial connector parts may be inserted in the form of independent modules into corresponding cutouts in a plastic housing which is common to them. If not, the plastic housing has to have corresponding insertion apertures on its rear wall for inserting the rectangular coaxial inner conductors and, once the rectangular coaxial inner conductors have been inserted, the insertion apertures have to be sealed with covers such that they are impervious to radio frequencies.

The invention is based on the recognition of the fact that the metallized housing of an RF angle-connector part, which has the coaxial outer conductors of the various coaxial connection paths at least partially integrated in it, is adequate without additional insertion apertures for inserting the coaxial inner conductors. The reason for this is that the rectangular coaxial inner conductors can be divided into two straight inner-conductor sections which are oriented perpendicular to one another and are combined with one another in a suitable manner to form rectangular coaxial inner conductors during insertion into the housing.

In accordance with an added feature of the invention, the base is a printed circuit board.

In accordance with an additional feature of the invention, the coaxial outer conductors are one of inserted and screwed into the housing and integrated with the housing.

In accordance with another feature of the invention, the press fit contact heads of the inner-conductor connection pieces have terminal slots formed therein; the coaxial connector-part module has a bottom part locked to the housing, the bottom part has a dielectric mounting plate with a top for supporting the inner-conductor connection pieces, the top of the dielectric mounting plate has dielectric support pillars with the inner-conductor plug parts embedded therein up to the terminal slots of the press-fit contact heads; the top of the dielectric mounting plate additionally has at least one plug part having a locking element; the recesses of the housing are formed in the bottom of the housing and include a central cutout, pillar holding apertures and a further holding aperture with a mating lock aperture, the bottom part having the dielectric mounting plate is received in the central cutout, the pillar holding apertures receiving the dielectric support pillars having the inner-conductor plug parts, the further holding aperture with the mating lock aperture receiving and locking with the locking element of the at least one plug part; and only after the bottom part has been locked to the housing can the coaxial inner conductors of the coaxial connector parts be inserted into and connected in the highly conductive manner to the press-fit contact heads of the inner-conductor plug parts.

In accordance with a further added feature of the invention, the pillar holding apertures and the further aperture have a rectangular cross-section; the dielectric support pillars of the bottom part have longitudinal grooves formed therein for matching the characteristic impedance, the dielectric support pillars have a cross section matching the rectangular cross-section of the pillar holding apertures disposed in the bottom of the housing; and the dielectric support pillars having funnel shaped holes formed therein, the holes exposing the terminal slots of the press-fit contact heads of the inner-conductor plug parts and serving to center the ends of the coaxial inner conductors to be pressed into the press-fit contact heads.

In accordance with a further additional feature of the invention, the housing has mutually parallel side walls and a rear wall, the contact bearing feet are disposed on an exterior of the housing at the bottom on the mutually parallel side walls and the rear wall, and projecting slightly beyond the bottom part inserted into the housing.

In accordance with yet another feature of the invention, the contact bearing feet are short outer-wall attachments in a manner of support teeth, and together form a comb-like structure on the mutually parallel side walls and the rear wall of the housing.

In accordance with another added feature of the invention, the remainder of the metallized surface areas of the housing are divided into further metallized regions between the coaxial outer conductors for electrically isolating the further metallized regions from each other.

In accordance with another additional feature of the invention, the metallized regions of the metallized surface areas of the housing are isolated from one another by partial removal of lines in the metallized surface areas of the housing.

In accordance with an added feature of invention, the lines are removed by laser processing.

In accordance with an additional feature of the invention, the coaxial connector parts are disposed in a row/column pattern on the housing; there is a mounting plate; the housing has at least one plate-shaped elevated area constituting a stop and has a hole formed therein disposed in the front wall in a center region between the coaxial connector parts for receiving a fixing screw to additionally mount the housing to the mounting plate; and including a contact plate having contact prongs at an edge slightly bent away forwards in a direction towards the mounting plate and disposed on the front wall of the housing for forming a highly conductive contact between the mounting plate and the metallized surface areas of the housing.

In accordance with another feature of the invention, the coaxial outer conductors are disposed on the front wall of the housing and are an integral component of the housing.

In accordance with a further added feature of the invention, the housing has outer conductor recesses formed therein and the coaxial outer conductors are metallic sleeves disposed on the front wall in the outer conductor recesses, the coaxial outer conductors are one of screwed, pressed and inserted into the outer conductor recesses.

In accordance with a further additional feature of the invention, there are dielectric sleeves disposed in the coaxial outer conductors receiving and housing the coaxial inner conductors.

In accordance with yet another feature of the invention, the base has centering holes formed therein, and the housing has centering devices disposed on the bottom for centering the housing on the base.

In accordance with another added feature of the invention, the centering devices are centering pins.

In accordance with another additional feature of the invention, the metallized surface areas have a layer thickness of metallization at least equal to a penetration depth of electromagnetic waves to be transmitted via the coaxial connector-part module.

In accordance with yet another added feature of the invention, the housing has exterior surfaces with non-metallized surface sub-areas.

In accordance yet another additional feature of the invention, the bearing surfaces constituting the SMD connections have a planarity less than 0.1 mm.

With the foregoing and other objects in view there is also provided, in accordance with the invention, a method for automatic assembly of the RF coaxial angle-connector part, which includes: punching the inner-conductor connection pieces from a metallic continuous support strip having positioning holes; continuously prefabricating the bottom part by a plastic injection-molding processes using the continuous support strip guided by the positioning holes; fitting and locking the housing onto the bottom part; mounting the coaxial connector parts on the front wall of the housing; cutting off the housing locked to the bottom part from the continuous support strip; and forming isolation regions between the inner-conductor connection pieces and other parts of the bottom part.

In accordance with a concomitant feature of the invention, there is the step of punching out the contact plate having the contact prongs from the metallic continuous support strip.

Other features which are considered as characteristic for the invention are set forth in the appended claims.

Although the invention is illustrated and described herein as embodied in a RF coaxial angle-connector part and method for its production, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
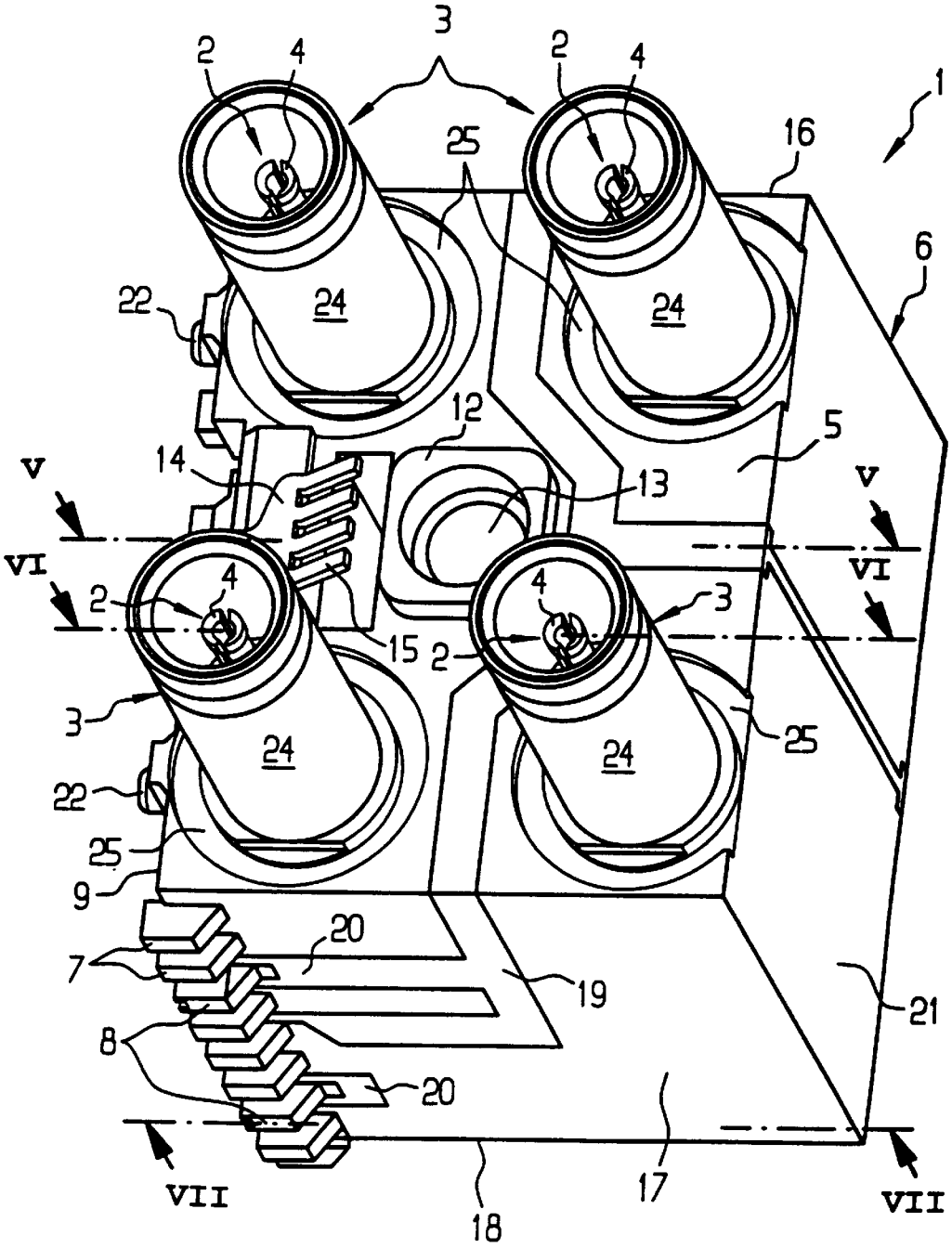
FIG. 1 is a perspective view of an exemplary embodiment of a coaxial connector-part module on an end wall according to the invention.

In all the figures of the drawing, sub-features and integral parts that correspond to one another bear the same reference symbol in each case. Referring now to the figures of the drawing in detail and first, particularly, to FIGS. 1 and 2 thereof, there is shown an exemplary embodiment of a coaxial connector-part module 1 shown in different views in FIGS. 1 and 2. Free ends of coaxial inner conductors 2 of coaxial connector parts 3 are configured as connector sockets 4. The connector sockets 4 may of course also be replaced by the connector pins that are complementary to them. On an end wall 5 of its metallized-plastic housing 6, the coaxial connector-part module 1 is equipped with four of the coaxial connector parts 3 in a row/column configuration. The number and arrangement of the coaxial connector parts 3 with which such RF coaxial angle-connector parts are equipped may of course be varied. The layer thickness of the metallization of the housing 6 is in this case is chosen to be at least equal to the penetration depth of the electromagnetic waves to be transmitted via the coaxial connector-part module 1.

The coaxial connector-part module 1 has a multiplicity of contact bearing feet 7 and 8 that are disposed on the outer side of the housing 6 near the bottom 9. The contact bearing feet 7 and 8 have bearing surfaces that are configured as SMD connections 10 and 11 that can be tinned. They are used both for mounting the housing on a base, in particular a printed circuit board, as well as for electrically connecting the SMD connections 10 and 11 to connections assigned to the latter on the base.

The center region between the coaxial connector parts 3 on the end wall 5 of the housing 6 is provided with a plate-shaped elevated area 12 which constitutes a stop and has a hole 13 for a fixing screw. This makes it possible to mount the coaxial connector-part module 1, by its end wall 5, on a non-illustrated mounting plate that in this case must have holes for the coaxial connector parts 3 to pass through. In order to ensure a highly conductive contact between the mounting plate and the metallization of the housing 6 in this case, a contact plate 14 is provided. At its free end, the contact plate 14 merges into contact prongs 15 that are bent slightly upwards.

The exterior sides of the mutually parallel side walls 16 and 17, and a rear wall 18 of the housing 6 are provided with a relatively large number of contact bearing feet 7 and 8 which have a comb-like structure. They are formed in the manner of support teeth, and their SMD connections 10 and 11 project slightly beyond the bottom 9 of the housing 6. In order to ensure satisfactory solder connections when connecting the coaxial connector-part module 1 to a base for the SMD connections 10 and 11, it is necessary to provide a planarity tolerance of <0.1 mm between all the SMD connections 10 and 11 of the contact bearing feet 7 and 8.

Using non-metallized, annularly self-closing strips 19 on the outer sides of the housing 6, the electrical connection between the outer conductors of the coaxial conductor sections present in the coaxial connector-part module can be interrupted as desired. In the exemplary embodiment of a coaxial connector-part module 1 shown in the drawing, the external metallization (not shown in greater detail) of the housing 6 is divided up into three large metallized regions by the non-metallized strips 19 as shown clearly in FIGS. 1 and 2. This division means that only those outer conductors of the coaxial conductor sections to which the two coaxial connector parts 3 near to the bottom 9 of the housing 6 belong are now connected to one another in an electrically conductive manner. In contrast, each of the outer conductors of the two other coaxial conductor sections, which are constituted by the remaining two coaxial connector parts 3, are insulated from the outer conductors of all the other coaxial conductor sections. Apart from these three large metallized regions produced by the non-metallized strips 19, the SMD connections 11 of the metallized contact bearing feet 8 must also have metallized regions which are insulated from the remainder of the metallization. This is achieved by non-metallized strips 20 which annularly surround the contact bearing feet 8 and thus define a dedicated small metallized region for each contact bearing foot 8.

The non-metallized strips 19 and 20 can be produced simply by partial removal of lines in the external metallization of the housing 6 by milling or vaporization. In addition, it should be emphasized that it is not necessary, in principle, to metallize the entire housing 6, that is to say all of the housing exterior sides as well. For example, side wall 21 of the housing 6 which is parallel to the bottom 9 does not need to be metallized at all. It is also possible to metallize the walls of the housing 6 only to the extent that is absolutely necessary for the coaxial conductor sections which are to be provided in the coaxial connector-part module 1.

The configuration of the contact bearing feet 7 and 8 on the outer side of the mutually parallel side walls 16 and 17 and the rear wall 18 is important for soldering the SMD connections 10 and 11 on a base, because this makes it possible to direct the circulating-air heat used in the soldering process to the SMD connections 10 and 11 in a beneficial manner. Furthermore, it is thus easy to check afterwards whether the solder points are satisfactory. In addition, this configuration of the contact bearing feet 7 and 8 has the advantage that it provides the optimum preconditions for mounting the coaxial connector-part module 1 on a base.

Figure 2:
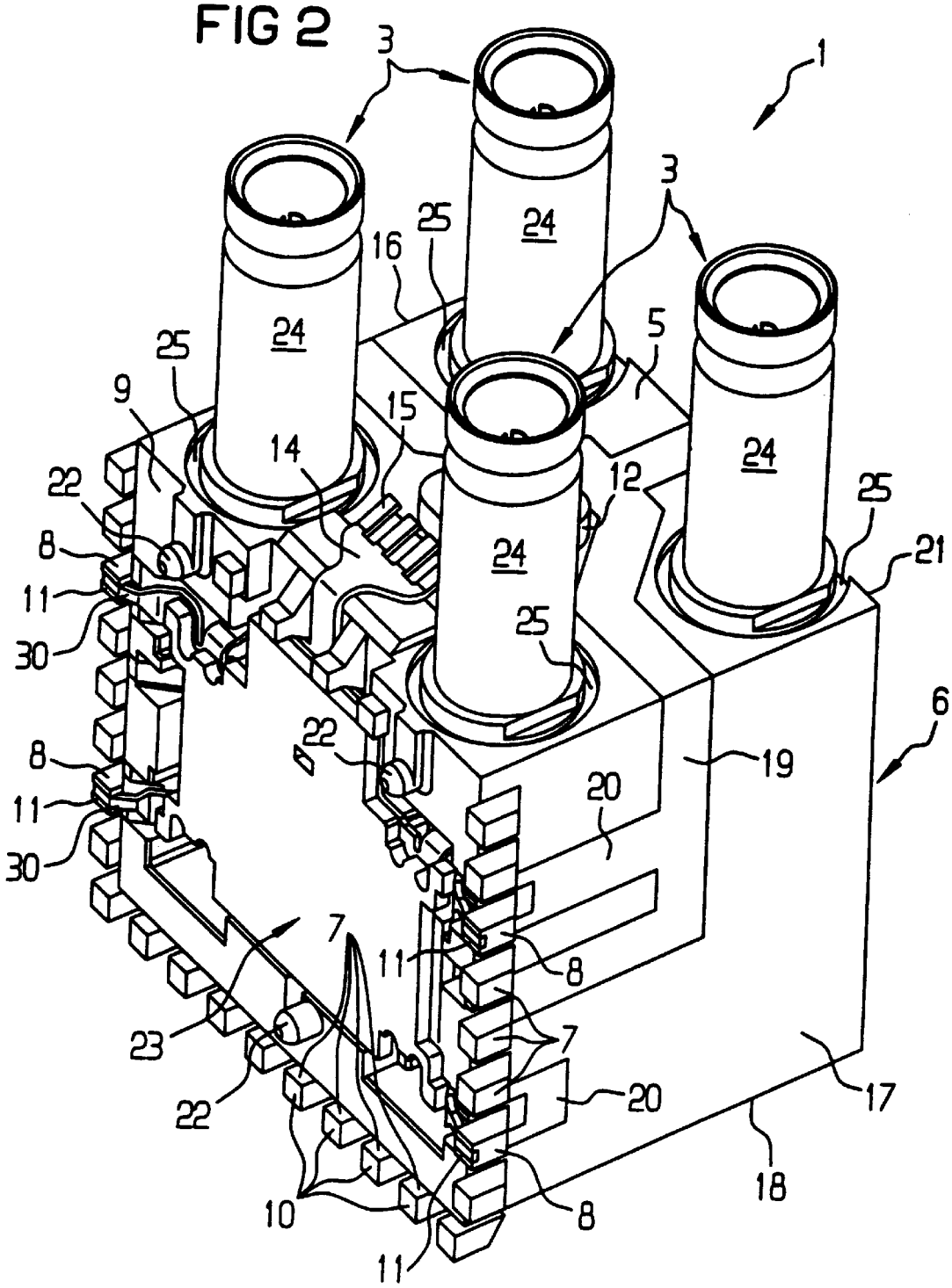
FIG. 2 is a perspective view of the coaxial connector-part module on the end wall oriented to show a bottom of a housing.

As shown clearly in FIG. 2, the bottom 9 of the housing 6 is provided with centering pins 22 which, when placing the housing 6 on the base, engage in centering holes allocated to them in a base and thus ensure that the SMD connections 10 and 11 of the contact bearing feet 7 and 8 and their connections on the base are assigned to one another correctly.

The coaxial connector-part module 1 shown in FIGS. 1 and 2 includes two main parts, specifically the actual housing 6 having the coaxial connector parts 3 and a bottom part 23 which is inserted in the bottom 9 of the housing 6 and is locked to the housing 6. In the exemplary embodiment illustrated, the coaxial outer conductors 24 of the coaxial connector parts 3 are metallic sleeves that are screwed into recesses 25 in the housing 6 that are matched to them. These refinements of the coaxial connector-part module 1 can be clearly seen in FIG. 3, which illustrates the fully automatic assembly of the coaxial connector-part module shown here in an exploded view.

Figure 3:
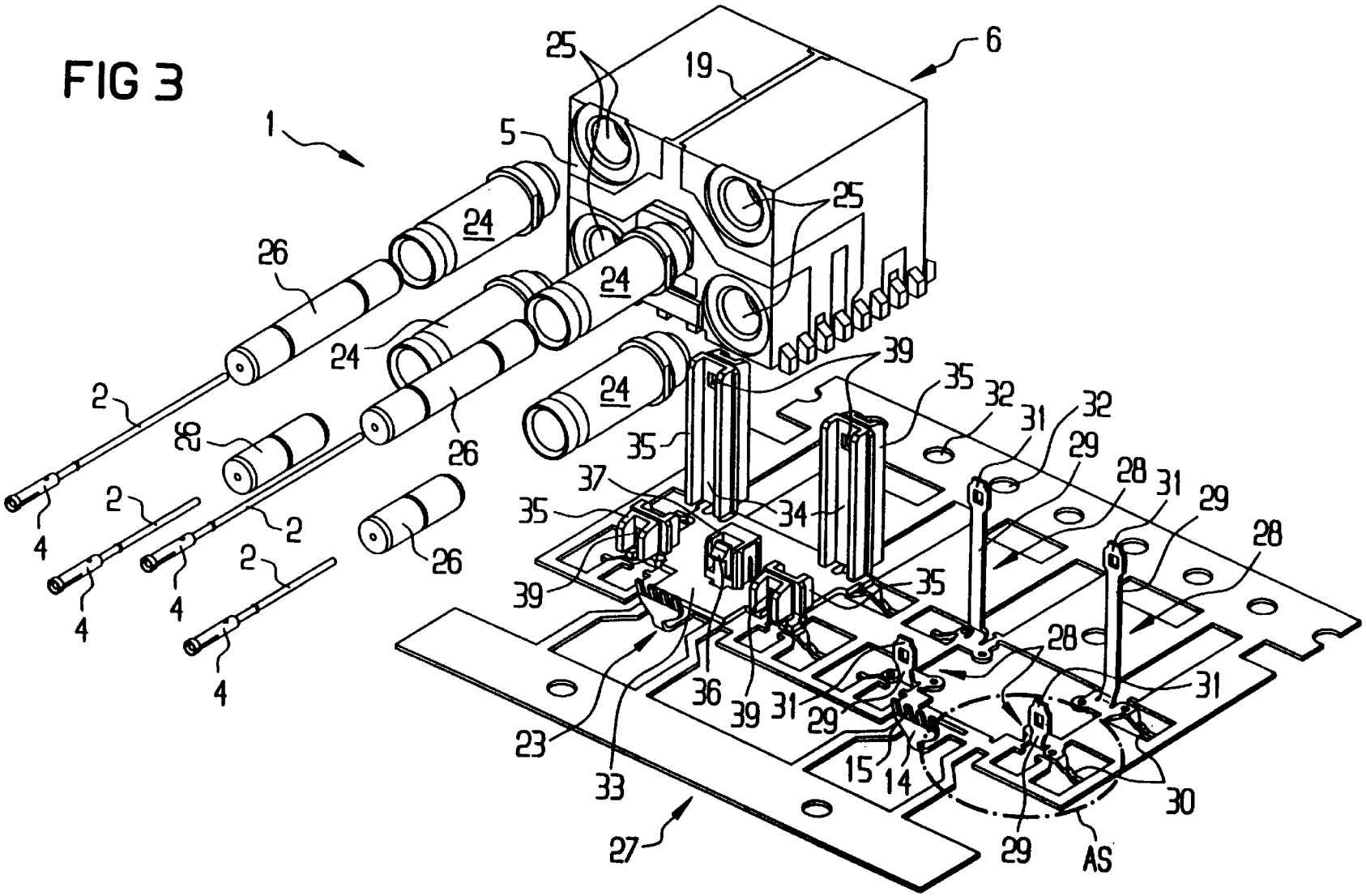
FIG. 3 is an exploded, perspective view of the coaxial connector-part module in conjunction with a continuous support strip used for its fully automatic assembly.
Figure 4:
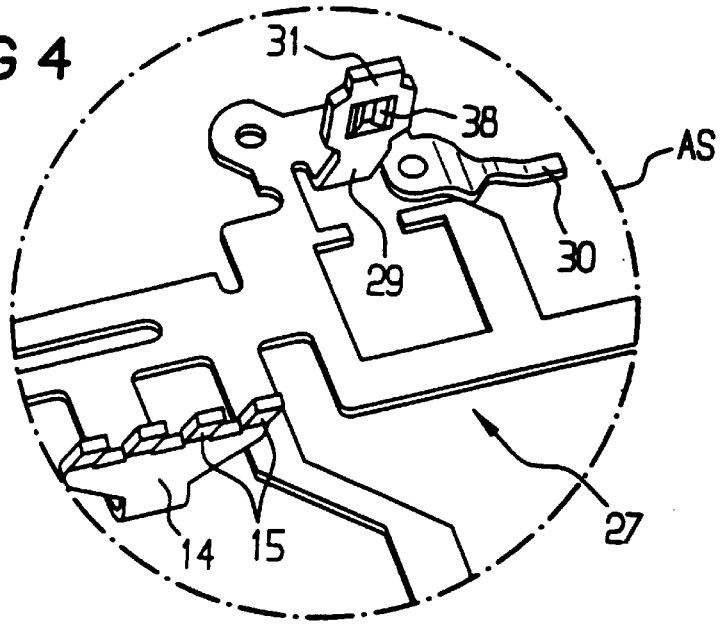
FIG. 4 is an enlarged, perspective, detail view of the continuous support strip shown in FIG. 3.

As shown in FIG. 3, the intrinsically straight coaxial inner conductors 2 of the coaxial connector parts 3, mounted in dielectric sleeves 26, are configured so that they can be pushed into their coaxial outer conductors 24. For fully automatic assembly of the coaxial connector-part module 1, use is made of a punched metallic continuous support strip 27, of which a section long enough to produce two bottom parts 23 is illustrated in FIG. 3. For each bottom part 23, the metallic continuous support strip 27 has four inner-conductor connection pieces 28, which produce the conductive connection between the coaxial inner conductors 2 of the four coaxial connector parts 3 and the SMD connections 11 assigned to them on the contact bearing feet 8. The inner-conductor connection pieces 28 each include two sections that are disposed essentially perpendicular to one another, specifically an inner-conductor plug part 29 and an SMD inner-conductor foot 30. In this case, the inner-conductor plug parts 29 are oriented perpendicular to the coaxial inner conductors 2 of the coaxial connector parts 3, and are provided with a press-fit contact head 31 at their free end. In order to indicate these inner-conductor connection pieces 28, the detail AS, marked in FIG. 3, of the continuous support strip 27 is shown again in FIG. 4 in an enlarged view. The continuous support strip 27 also has the contact plate 14, having the contact prongs 15, which is provided on the end wall 5 of the coaxial connector-part module 1.

Using the continuous support strip 27, which is guided at the edges by positioning holes 32 as it moves onwards, the bottom parts 23 are continuously produced by plastic injection-molding processes. In each injection-molding process, a dielectric mounting plate 33 having four encapsulated inner-conductor plug parts 29, in the form of rectangular dielectric support pillars 35 provided with longitudinal grooves 34, and a plug part 37 having a locking element 36 are produced in the plane of the continuous support strip 27. The plug part 37 is in this case disposed in the space between the four dielectric support pillars 35. As can be seen in FIG. 3, the inner-conductor plug parts 29 are completely embedded in the dielectric support pillars 35. The dielectric support pillars only have holes 39 exposing the terminal slots 38 (FIG. 4) in the press-fit contact heads 31 of the inner-conductor plug parts 29. The funnel-shaped configuration of the holes 39 serving to center the rear ends of the coaxial inner conductors 2 which are to be pressed into the press-fit contact heads 31.

In order to hold the bottom part 23, which includes the dielectric mounting plate 33 having the dielectric support pillars 35 and the plug part 37, the bottom 9 of the housing 6 of the coaxial connector-part module 1 has a central cutout 40, four rectangular holding apertures 41, constituting outer-conductor sections, for the dielectric support pillars 35, and a further rectangular holding aperture 42 having a mating lock 43 for the plug part 37 having the locking element 36. The central cut-out 40, the holding aperture 41 and the holding aperture 42 having the mating lock 43 can be seen in the sections V, VI and VII of FIG. 1, which are indicated in FIG. 1 and shown in FIGS. 5 to 7.

As soon as a bottom part 23 on the continuous support strip 27 is finished, the housing 6 is picked up on the side wall 21 parallel to its bottom 9 by a pick & place machine, and placed onto the bottom part 23 from above and locked to the latter. For the pick & place machine to perform the picking-up operation of the housing 6, it is important that the surface of the side wall 21 is sufficiently planar for this purpose. The coaxial connector parts 3 are then mounted on the end wall 5 of the housing 6. Finally, its housing 6, with its bottom part 23, is cut off from the continuous support strip 27, and the DC isolation required between the inner-conductor connection pieces 28 and the remainder of the parts of the original continuous support strip 27 is produced.

Figure 5:
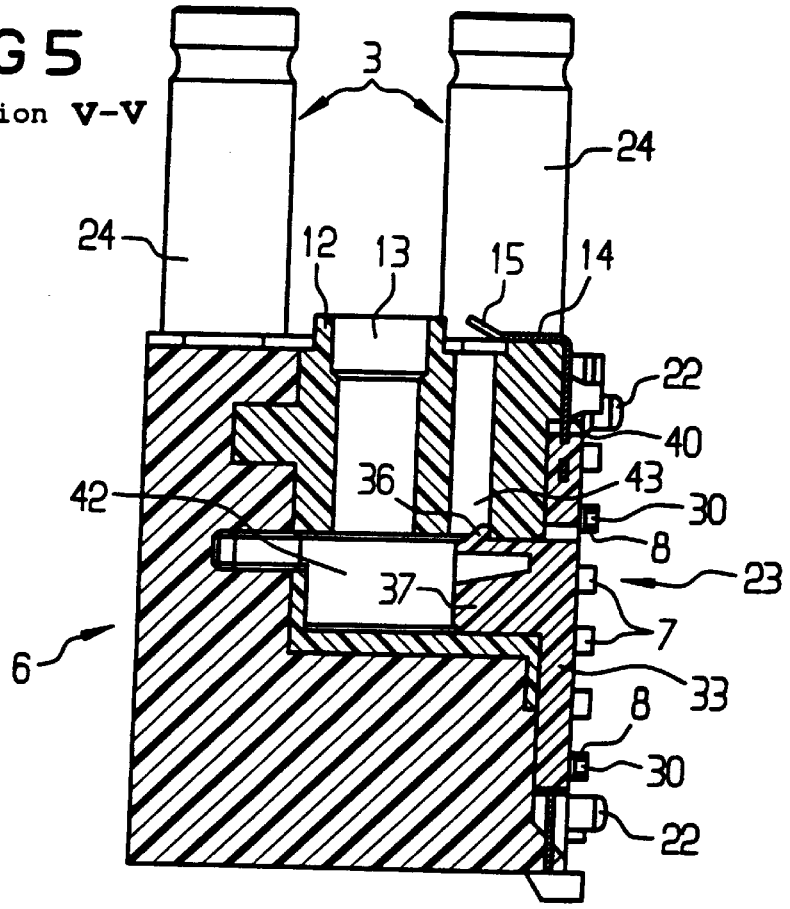
FIG. 5 is a sectional view the coaxial connector-part module taken along the line V—V shown in FIG. 1.

The section V, shown in FIG. 5, through the coaxial connector-part module 1 clearly shows the bottom part 23 inserted with its dielectric mounting plate 33 into the central cut-out 40 in the bottom 9 of the housing 6. The mating lock 43 in the rectangular holding aperture 42 for the plug part 37 includes a recess which opens from the side into the holding aperture 42 and in which the locking hook of the locking element 36 including a resilient locking hook engages.

Figure 6:
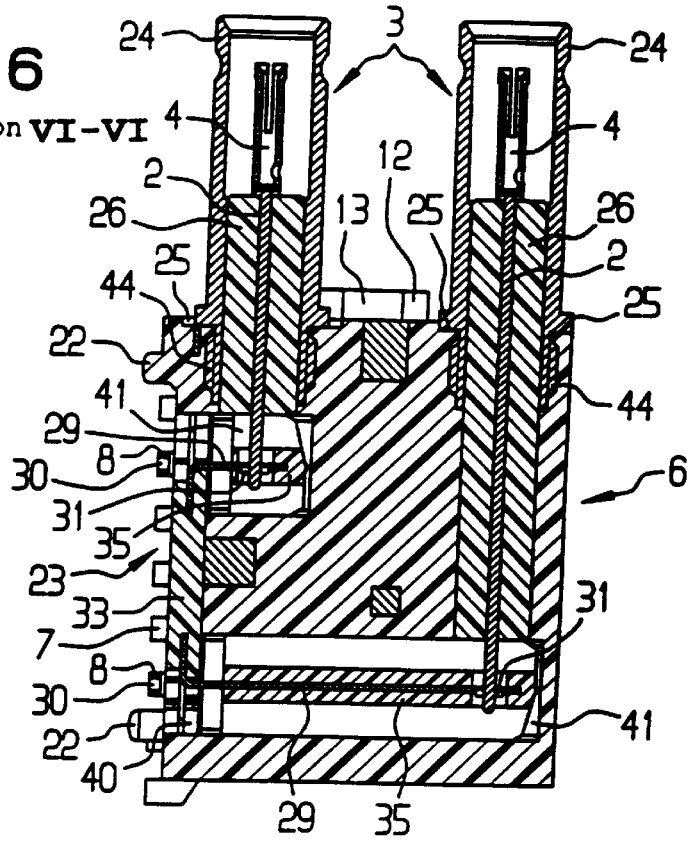
FIG. 6 is a sectional view of the coaxial connector-part module taken along the line VI—VI shown in FIG. 1.
Figure 7:
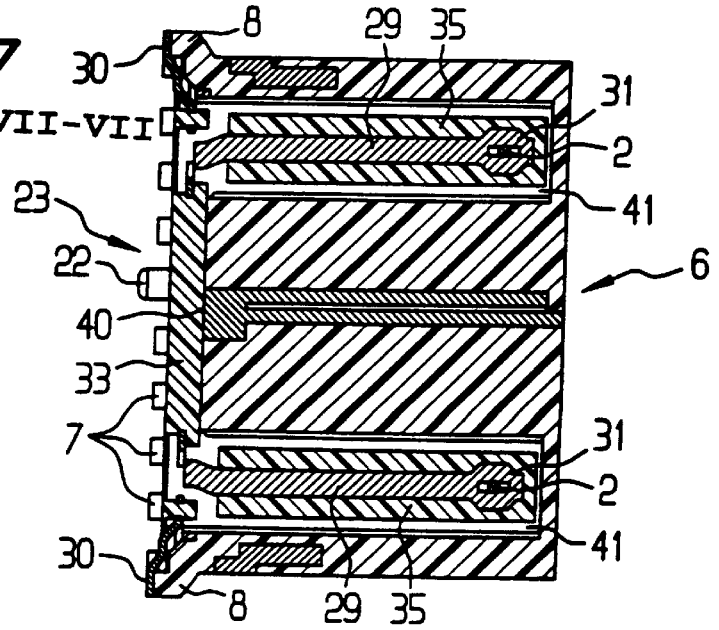
FIG. 7 is a sectional view of the coaxial connector-part module taken along the line VII—VII shown in FIG. 1.

The sections VI and VII, shown in FIGS. 6 and 7, through the coaxial connector-part module 1 in FIG. 1 show the rectangular holding apertures 41 which have an outer-conductor function for the inner-conductor plug parts 29. The conductive connections produced between the coaxial inner conductors 2 of the coaxial connector parts 3 and the press-fit contact heads 31 at the free ends of the inner-conductor plug parts 29 are also shown.

Furthermore, FIG. 6 shows a screw connection 44 of the coaxial outer conductors 24, inserted into recesses 25 in the housing 6, of the coaxial connector parts 3. In addition, FIG. 7 clearly shows the SMD inner-conductor feet 30 whose free ends are pushed into the contact bearing feet 8 assigned to them, on the side where the SMD connections 11 are located.

We claim:

1. In combination with a base having connectors, a RF coaxial angle-connector part, comprising:

a coaxial connector-part module to be mounted on the base and including a plastic housing having recesses formed therein, a front wall and a bottom with an edge, said housing also having metallized surface areas;

coaxial connector parts disposed in said front wall of said housing, said coaxial connector parts having coaxial outer conductors and straight rod shaped inner conductors with ends disposed in an insulated fashion in said coaxial outer conductors;

a multiplicity of contact bearing feet having bearing surfaces constituting SMD connections with metallized surfaces disposed at said edge of said bottom of said housing for mounting said housing on the base and conductively connecting said SMD connections to the connectors of the base;

said metallized surface areas of said housing divided up into metallized regions at least between said metallized surfaces of said SMD connections and a remainder of said metallized surface areas of said housing for electrically isolating said metallized regions from one another for DC isolation;

metallic inner-conductor connection pieces disposed in an insulated fashion in said recesses of said housing perpendicular to said coaxial connector parts, said inner-conductor connection pieces each having an inner-conductor plug part and an SMD inner-conductor foot disposed substantially perpendicular to said inner-conductor plug part, said SMD inner-conductor foot extending into a respective bearing surface of said contact bearing feet, said inner-conductor plug part having a press-fit contact head receiving one of said ends of a respective coaxial inner conductor and forming a highly conductive connection with said respective coaxial inner conductor; and said inner-conductor connection pieces, said coaxial connector parts and said contact bearing feet forming coaxial connection paths dimensioned to have an at least substantially constant characteristic impedance.

2. The RF coaxial angle-connector part according to claim 1, wherein the base is a printed circuit board.

3. The RF coaxial angle-connector part according to claim 1, wherein said coaxial outer conductors are one of inserted and screwed into said housing and integrated with said housing.

4. The RF coaxial angle-connector part according to claim 1, wherein:

said press fit contact head of said inner-conductor plug part has a terminal slot formed therein;

said coaxial connector-part module has a bottom part locked to said housing, said bottom part having a dielectric mounting plate with a top for supporting said inner-conductor connection pieces, said top of said dielectric mounting plate having dielectric support pillars each with said inner-conductor plug part embedded therein up to said terminal slot of said press-fit contact head;

said top of said dielectric mounting plate additionally having at least one plug part having a locking element;

said recesses of said housing are formed in said bottom of said housing and include a central cutout, pillar holding apertures and a further holding aperture with a mating lock aperture, said bottom part having said dielectric mounting plate received in said central cutout, said pillar holding apertures receiving said dielectric support pillars having said inner-conductor plug parts, said further holding aperture with said mating lock aperture receiving and locking with said locking element of said at least one plug part; and only after said bottom part has been locked to said housing can said coaxial inner conductors of said coaxial connector parts be inserted into and connected in said highly conductive manner to said press-fit contact heads of said inner-conductor plug parts.

5. The RF coaxial angle-connector part according to claim 4, wherein:

said pillar holding apertures and said further aperture have a rectangular cross-section;

said dielectric support pillars of said bottom part have longitudinal grooves formed therein for matching said characteristic impedance, said dielectric support pillars having a cross section matching said rectangular cross-section of said pillar holding apertures disposed in said bottom of said housing; and said dielectric support pillars having funnel shaped holes formed therein, said holes exposing said terminal slot of said press-fit contact head of said inner-conductor plug part and serving to center said ends of said coaxial inner conductors to be pressed into said press-fit contact heads.

6. The RF coaxial angle-connector part according to claim 4, wherein said housing has mutually parallel side walls and a rear wall, said contact bearing feet disposed on an exterior of said housing at said bottom on said mutually parallel side walls and said rear wall, and projecting slightly beyond said bottom part inserted into said housing.

7. The RF coaxial angle-connector part according to claim 6, wherein said contact bearing feet are short outer-wall attachments in a manner of support teeth, and together forming a comb-like structure on said mutually parallel side walls and said rear wall of said housing.

8. Th RF coaxial angle-connector part according to claim 1, wherein said remainder of said metallized surface areas of said housing are divided into further metallized regions between said coaxial outer conductors for electrically isolating said further metallized regions from each other.

9. The RF coaxial angle-connector part according to claim 1, wherein said metallized regions of said metallized surface areas of said housing are isolated from one another by partial removal of lines in said metallized surface areas of said housing.

10. The RF coaxial angle-connector part according to claim 9, wherein said lines are removed by laser processing.

11. The RF coaxial angle-connector part according to claim 1, wherein said coaxial connector parts are disposed in a row/column pattern on said housing;

including a mounting plate;

wherein said housing has at least one plate-shaped elevated area constituting a stop and having a hole formed therein disposed in said front wall in a center region between said coaxial connector parts for receiving a fixing screw to additionally mount said housing to said mounting plate; and including a contact plate having contact prongs at an edge slightly bent away forwards in a direction towards said mounting plate and disposed on said front wall of said housing for forming a highly conductive contact between said mounting plate and said metallized surface areas of said housing.

12. The RF coaxial angle-connector part according to claim 1, wherein said coaxial outer conductors are disposed on said front wall of said housing and are an integral component of said housing.

13. The RF coaxial angle-connector part according to claim 1, wherein said housing has outer conductor recesses formed therein and said coaxial outer conductors are metallic sleeves disposed on said front wall in said outer conductor recesses, said coaxial outer conductors are one of screwed, pressed and inserted into said outer conductor recesses.

14. The RF coaxial angle-connector part according to claims 1, including dielectric sleeves disposed in said coaxial outer conductors receiving and housing said coaxial inner conductors.

15. The RF coaxial angle-connector part according to claim 1, wherein the base has centering holes formed therein, and said housing has centering devices disposed on said bottom for centering said housing on the base.

16. The RF coaxial angle-connector part according to claim 15, wherein said centering devices are centering pins.

17. The RF coaxial angle-connector part according to claim 1, wherein said metallized surface areas have a layer thickness of metallization at least equal to a penetration depth of electromagnetic waves to be transmitted via said coaxial connector-part module.

18. The RF coaxial angle-connector part according to claim 1, wherein said housing has exterior surfaces with non-metallized surface sub-areas.

19. The RF coaxial angle-connector part according to claim 1, wherein said bearing surfaces constituting said SMD connections have a planarity less than 0.1 mm.

* * * * *